United States Patent [19]

Akkerman

[11] Patent Number: 4,768,594

[45] Date of Patent: Sep. 6, 1988

[54] VALVES

[75] Inventor: Neil H. Akkerman, Houston, Tex.

[73] Assignee: AVA International Corporation, Houston, Tex.

[21] Appl. No.: 922,846

[22] Filed: Oct. 24, 1986

Related U.S. Application Data

[63] Continuation-in-part of Ser. No. 879,537, Jun. 24, 1986, abandoned, which is a continuation of Ser. No. 614,812, May 29, 1984, abandoned.

[51] Int. Cl.[4] ..... E21B 34/08

[52] U.S. Cl. ..... 166/319; 166/65.1

[58] Field of Search ..... 166/65.1, 319, 332, 166/334; 251/1 R

[56] References Cited

U.S. PATENT DOCUMENTS

| | | | |
|---|---|---|---|
| 1,026,041 | 5/1912 | Kimball . | |
| 2,321,095 | 6/1943 | Mantz . | |
| 2,875,616 | 3/1959 | Marks . | |
| 3,355,139 | 11/1967 | Kittredge | 251/30 |
| 3,358,207 | 12/1967 | Natho | 318/466 |
| 3,604,679 | 9/1971 | Pennington | 251/25 |
| 3,665,955 | 5/1972 | Conner, Sr. | 137/495 |
| 3,731,742 | 5/1973 | Sizer | 166/315 |
| 4,002,202 | 1/1977 | Huebsch et al. | 166/65 |
| 4,129,184 | 12/1978 | Parker | 166/65.1 X |
| 4,161,215 | 7/1979 | Bourne, Jr. et al. | 166/65 |
| 4,191,248 | 3/1980 | Huebsch et al. | 166/65 |
| 4,375,239 | 3/1983 | Barrington et al. | 166/65.1 X |
| 4,386,422 | 5/1983 | Mumby et al. | 367/85 |

*Primary Examiner*—Stephen J. Novosad
*Assistant Examiner*—William P. Neuder
*Attorney, Agent, or Firm*—Vaden, Eickenroht, Thompson & Boulware

[57] ABSTRACT

There are disclosed two embodiments of a valve for closing a well conduit within a wall bore to flow therethrough automatically in response to the loss of a controlled condition. Each embodiment of the valve has means in which energy may be generated, in response to bleeding off of pressure above the closed valve. So long as the controlled condition is maintained, the return of a pressure balance across the closed valve will permit the release of generated energy to open the valve. The loss of the controlled condition releases further generated energy to close the valve.

66 Claims, 6 Drawing Sheets

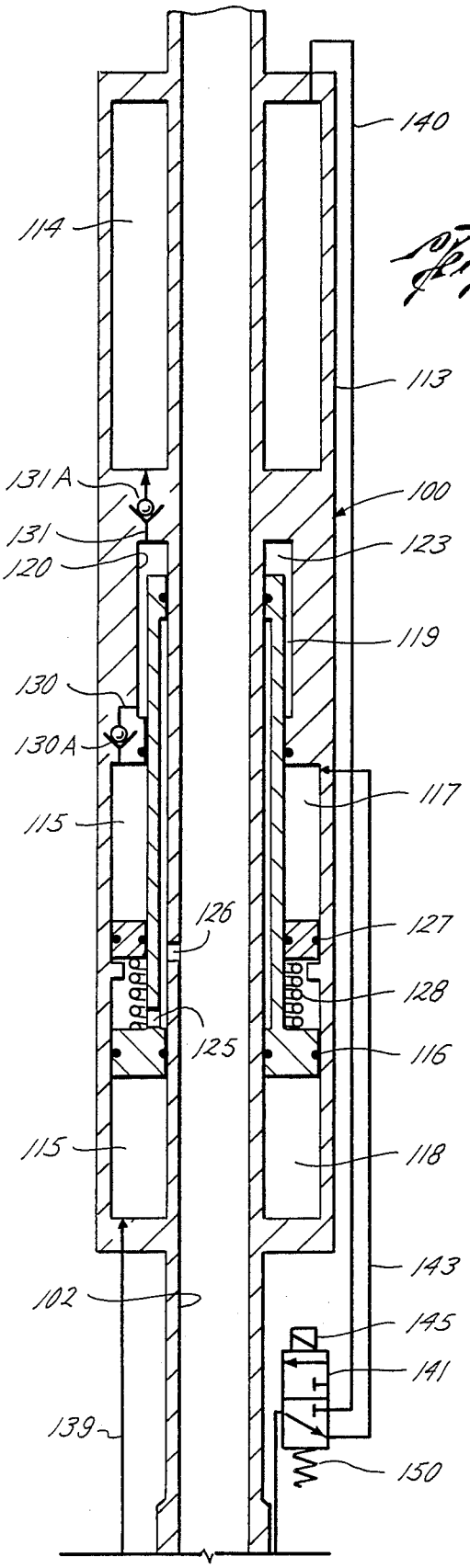
Fig. 8A
Fig. 8B
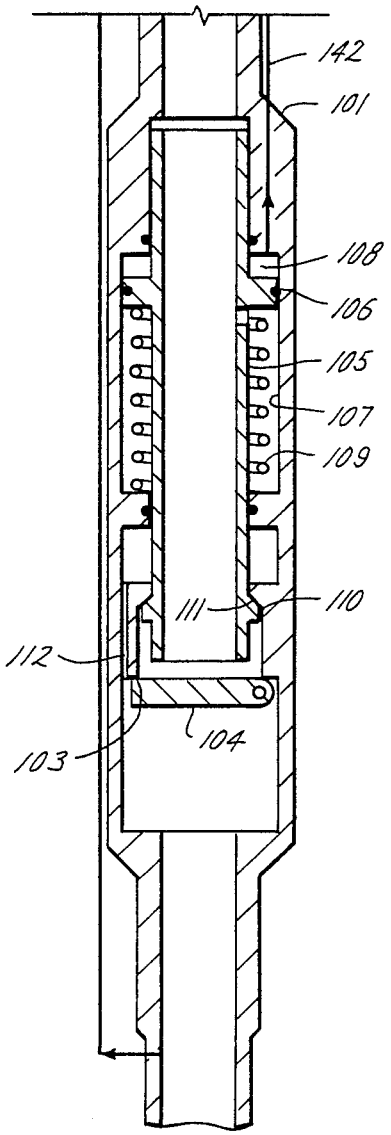

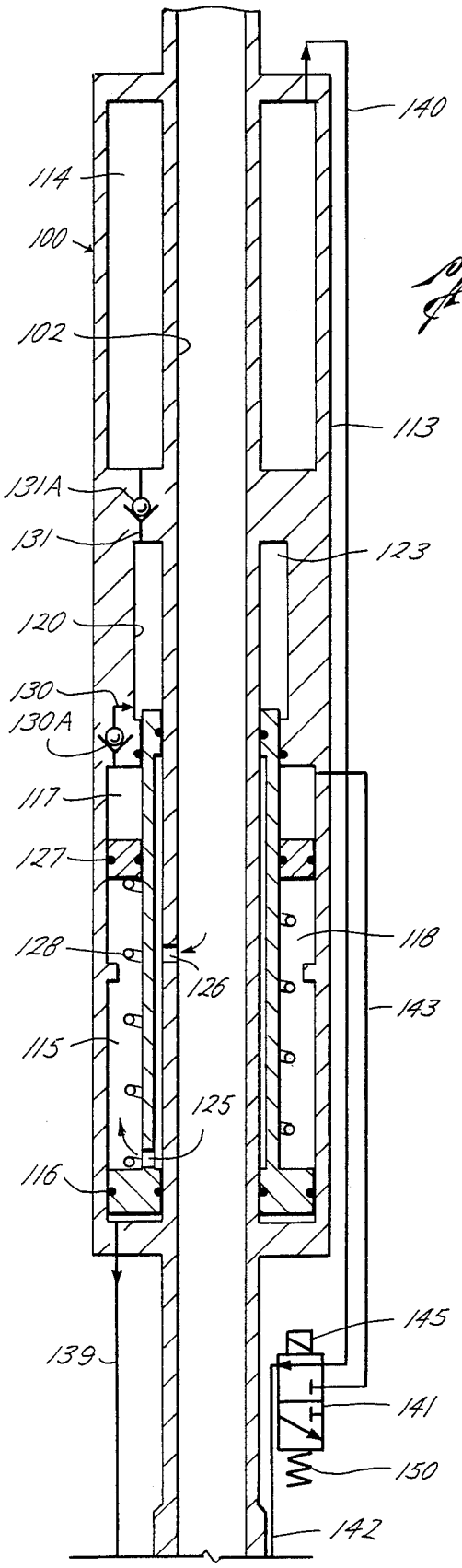
Fig. 10A
Fig. 10B
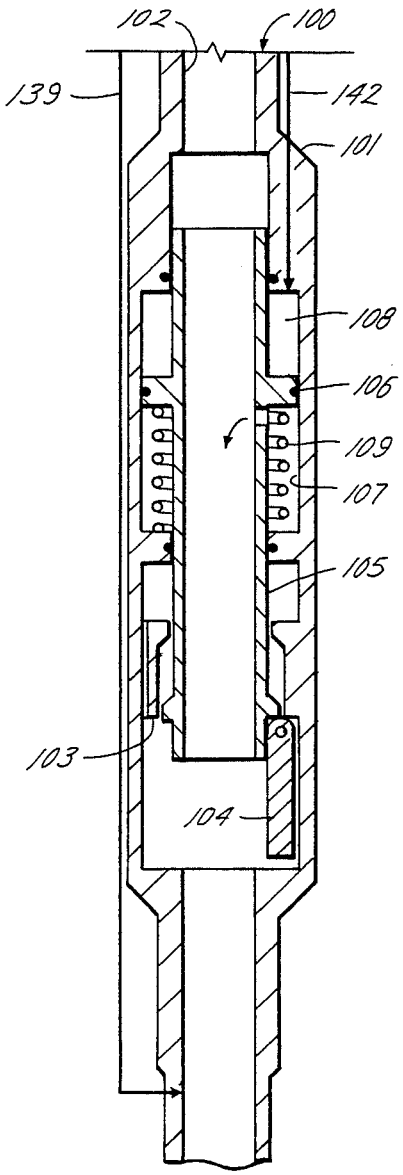

VALVES

This application is a continuation-in-part of my copending patent application, Ser. No. 879,537, filed June 24, 1986, which was a continuation of my patent application Ser. No. 614,812, filed May 29, 1984, both now abandoned.

Some prior valves of this latter type, often known as "storm chokes", are usually installed in the lower end of a production tubing for closing it in response to the velocity of the flow of well fluid therethrough, and thus, for example, in fail closed in the event of a blowout of the well. In such valves, the velocity at which the valve closes, and thus the controlled condition, may be changed by adjustment to the sizes of the orifices in the body of the valve through which the well fluid flows, or the force of a spring urging the closure member of the valve to open position, or both. If, however, the pressure of the formation from which the fluid is produced has dropped to a low level, adjustment of either or both of the the orifice sizes and the spring force may seriously interfere with production.

In other prior valves of this type, the closure member is adapted to be held open by a flow tube having a piston forming a chamber to which hydraulic control fluid is supplied from a source at the head of the well, but spring pressed to closed position in response to the reduction in pressure of the control fluid below a predetermined low value which permits the flow tube to be spring pressed to its original position. This loss in pressure of the control fluid may in turn occur in response to a predetermined fluid pressure condition, such as a rapid loss of wellhead flow pressure indicative of a blowout, or other controlled condition.

Since valves of the latter type require a fluid conduit extending between the wellhead and the fluid responsive operator for the closure member, and thus a long response time, they are ordinarily installed at the mud line of an offshore well, and thus do not provide protection for the full length of the tubing, as in the case of the velocity type valves. Also, it would be necessary to recomplete a well in order to replace the storm choke with a surface controlled value.

These and other problems could be overcome if the valve could be controlled by means at the surface requiring no physical connection with the valve, and thus installable deep in the well, as in the case of storm chokes, but at the same time independently of the condition of the well fluid, as in the case of surface controlled valves. It has been proposed to operate a valve or other mechanism deep within a production string of a well bore by transmitting electrical signals from the subsurface level to the valve through the earth. Such a valve requires a battery pack to provide the power necessary to control the valve in response to the receipt of a signal. Due to power drain from the battery pack, which is especially rapid in well bores where the temperature may be as high as 300° F., the energy available at the subsurface level would be limited, especially over a long period of time. This would be a particular problem in the case of a subsurface valve of the type described which may be left in the well for years, and which may have to operate—i.e., open, close, and then reopen—many times, whether due to an unavoidable loss of the controlled condition or a planned loss for test purposes.

It is the primary objective of this invention to provide a valve of this latter type which may be installed deep in the well bore, and which is controllable independently of velocity or flow lines connecting it to the surface, but which is well suited for operation in response to communication systems having subsurface power sources which are susceptible to depletion over the anticipated period of usage of the valve.

A more particular object is to provide such a valve which is self energized in the sense that it does not draw on the subsurface power source for either moving to open or closed position, but only for the purpose of providing a relatively small force to hold it open for so long as the controlled condition is maintained.

Still a further object is to provide a valve as described which may be interchanged with a storm choke controlling an existing well.

Still another object is to provide a valve of the type described which may be constructed at least in part in a manner similar to the above described fail closed valves which are controlled by a source of fluid pressure at the earth's surface.

Yet another object is to provide such a valve having a sealed chamber in which the power source and other electrical components of the communication system may be contained for protection from the surrounding environment, and, more particularly, having such a chamber which does not require a seal between the mechanical components of the valve and the electrical components.

These and other objects are accomplished, in accordance with the illustrated embodiments of the present invention, by a valve of the type described having means in which energy is generated in response to a pressure differential across the closure member while the closure member is in closed position, means operable, upon a reduction in the pressure differential, for releasing generated energy in order to move the closure member to open position and hold it in the open position so long as the controlled condition is maintained, and means operable, upon the loss of the controlled condition, for releasing further generated energy to move the closure member from open to closed position. When the valve is installed within a well conduit within a well bore, the pressure differential may be created by bleeding off the well fluid pressure in the well bore above the closed closure member, and then reduced, in accordance with one illustrated embodiment of the invention, by restoring well fluid pressure in the conduit above the closure member, and, in another illustrated embodiment, by equalizing pressure across the closure member. In either event, the only power required is that necessary to provide a force to hold the further generated energy, and thus hold the valve open, and, as will be apparent from the description to follow, this force may be of a very minor magnitude.

In the preferred and illustrated embodiments of the invention, the valve includes a battery and means including an actuator adapted to be activated by the battery, in response to an electrical signal transmitted from the earth's surface, for preventing release of the further energy so long as the power level of the battery is adequate to activate the actuator, but inoperable to prevent release of further stored energy when the power level is lost as a result of interruption of the signal and/or power drain from the battery. Due to an efficient mechanical connection between the actuator and the means in which the further energy is generated, only small power is required to control the valve, even over a period of years. Thus, the invention contemplates that the valve may be opened and closed repeatedly upon interruption of the signal, either for the purpose of providing fail safe control, or for test purposes in order to be assured that the valve is functioning properly and thus capable of providing fail safe control, if needed.

More particularly, in accordance with one embodiment, the valve includes a spring retainer which is movable with respect to the closure member, a first spring means which acts between the retainer and the body, a second spring means which acts between the retainer and the closure member, and means operable, in response to the pressure differential, and while the closure member is in the closed position, for shifting the retainer and closure member from a first to a second position with respect to one another in order to generate energy in both the first and second spring means, and to lock the retainer and closure member in their second position. In addition, the valve includes means operable, in response to a reduction of the pressure differential, to permit the energy generated in the first spring means to move the closure member with the retainer from its closed to its open position and hold it in open position so long as a controlled condition is maintained, as well as means operable, upon loss of the controlled condition, to release the retainer and closure member for movement from their second to their first position and thereby permit the closure member to be moved to closed position by energy generated in the second spring means.

Preferably, the retainer and closure member are so held and released by means which include toggle links connected at one end to the body, and means including a rod connected to the other end of the toggle links to extend them when the closure member is open and collapse them when the closure member and retainer are released for movement to their second position. More particularly, the actuator includes a solenoid for holding the links in extended position, so long as the power level of the battery is maintained and a position permitting the links to collapse upon the loss of said power level.

As illustrated, the retainer and closure member are shifted by means which includes a piston on the retainer which is sealably slidable within the closure member to an upper position, in response to the pressure differential, and to a lower position in response to a loss in the differential, and the aforementioned rod is mounted on the retainer for movement from a first position to a second position with respect thereto, means responsive to movement of the rod into its second position for locking the retainer in the upper position, and to movement of the rod into its first position for releasing the retainer for movement to its lower position, and means for moving the rod to the second position when the retainer is moved to its upper position to generate energy in the first and second spring means, and the closure member is closed, whereby the retainer is moved by well fluid to its lower position, when the pressure differential across the piston is reduced. More particularly, means are provided for urging the rod from its second to its first position so as to release the retainer from its upper position, whereby energy generated in the second spring means is able to move the closure member to closed position.

As illustrated, the body also includes an atmospheric chamber in which the toggle links, battery and solenoid are contained, the rod extends through an opening into the chamber for connection to the other end of the toggle link, and a torque tube which surrounds the rod is connected at opposite ends to the rod and the chamber wall through which the opening is formed. Thus, the torque tube serves to close off the atmospheric chamber about the rod as well as to provide a spring force to urge the rod from its second to its first position.

As also illustrated, the valve includes a generally cylindrical body adapted to be located within the well conduit and having ports in the side thereof connecting with an open upper end to provide a flowway which forms a continuation of the well bore, when the body is so located. A seat is formed about the flowway intermediate the ports and the open upper end, and the closure member includes a sleeve which is reciprocable within the body between an upper position engaged with the seat to close the flowway and a lower position spaced from the seat to open the flowway.

In accordance with another embodiment of the invention, the valve includes an accumulator which contains fluid whose pressure is increased in order to generate energy therein in response to a pressure differential across the the closure member while the closure member is in closed position, and a means which is operable, upon a reduction in the pressure differential, for releasing pressurized fluid from the accumulator in order to move the closure member to open position and hold it in open position as long as a controlled condition is maintained. The valve further includes spring means in which further energy is generated in response to movement of the closure member from closed to open position, and means operable, upon the loss of the controlled condition, for releasing the energy generated in the spring means in order to move the closure member from open to closed position. As in the first described embodiment, the valve further includes a power source, and means including an actuator adapted to be activated by the power source, in response to a signal transmitted from a location remote from the valve, for preventing release of further generated energy so long as the power level of the power source is adequate to activate the actuator, the actuator means also being inoperable to prevent release of the further generated energy when the power level is lost as a result of the interuption of the signal and/or powered drained from the power source. Still further, and again as in the first described embodiment of the valve, the power source is a battery and the actuator comprises a solenoid whose power requirement is only that necessary to prevent release of the further generated energy.

More particularly, and is in prior valves of the type above described, the valve includes a flow tube which is reciprocable within the body between a first position permitting the closure member to close and a second position moving the closure member to open position, and spring means which acts between the flow tube and body to urge the flow tube to its first position. The flow tube has piston means thereon forming an expandable and contractible fluid chamber, and a means is provided for releasing pressurized fluid from the accumulator into the chamber for moving the flow tube toward its second position, upon maintenance of the controlled condition, and, in response to movement of the flow tube towards its second position, for equalizing pressure across the closure member so that the flow tube continues move to its second position in order to move the closure member to open position and hold it in open position as long as the controlled condition is maintained. More particularly, a means is also provided which is operable upon the loss of the controlled condition to permit the pressurized fluid to return from the chamber to the accumulator, whereby energy generated in the spring means, as the flow tube moves to its second position, is released in order to return the flow tube to its first position and thereby permit the closure member to close.

In the illustrated and preferred embodiment of the invention, the accumulator includes a vessel and means having first and second oppositely facing pressure responsive surfaces which connect with the flowway on opposite sides of the closure member in order to increase the pressure of the fluid contained in the accumulator, when there is a pressure differential across the closure member, and to permit such pressure to decrease when the closure member is open, and the means operable to release and permit return of the pressurized fluid to and from the accumulator includes valve means moveable between a first position connecting the vessel and chamber as long as the controlled condition is maintained and a second position connecting the chamber with the second fluid responsive surface of the accumulator.

As in the first described embodiment, the valve is illustrated in an environment for controlling flow within a well bore, with the flowway of the body being adapted to form a continuation of a well conduit within the well bore, the flow tube being reciprocable in the body above the closure member between a first upper position and a second lower position and the accumulator pressure and spring means in which energy is generated being responsive to a differential in the pressure of well fluid across the closure member. In this illustrated embodiment of the invention, the body has an accumulator vessel as well as cylinder means formed therein, with piston means reciprocable within the cylinder means to form first and second expandable and contractible chambers, and one way valve means connecting the first chamber with the vessel to permit pressurized fluid to flow from the first chamber into the vessel. First conduit means connects the second chamber with the flowway beneath the closure member, and second conduit means connects the first chamber with the flowway above the closure member, whereby the pressure of accumulator fluid is increased, when the closure member is closed and the pressure of well fluid thereabove is vented, and permitted to decrease when the closure member is open. A third conduit means connects with the accumulator, a fourth conduit means connects with the chamber formed by the piston on the flow tube, a fifth conduit means connects with the first chamber, and the above described valve means is moveable between a first position connecting the third and fourth conduits, so that when the closure member is in closed position, pressurized fluid in the accumulator vessel is released to flow into the chamber formed by the piston on the flow tube, to urge the flow tube from its upper to its lower position, and a second position in which it connects the fourth and fifth conduit means to permit pressurized fluid to return from the chamber formed by the flow tube piston to the vessel.

More particularly, a means is provided in the body for equalizing the pressure of well fluid across the closure member as the flow tube moves downwardly, whereby energy generated in the accumulator fluid continues to move the flow tube downwardly, to open the closure member. Still further, the solenoid of the actuator is actuated by a signal from the earth's surface to hold the valve means in its first position, and thus hold the closure member in open position, so long as a controlled condition is maintained, but is deactivated when the controlled condition is lost so as to be inoperable to hold the valve means in its first position upon the loss of the controlled condition, and a means is provided which yieldably urges the valve means to its second position, whereby, upon return of pressurized fluid to the accumulator vessel, the energy generated in the spring means is effective to move the closure member to closed position.

In the drawings, wherein like reference characters are used throughout to designate like parts:

FIG. 1 is a vertical sectional view of a valve constructed in accordance with the first described embodiment of the invention and supported within the lower end of a tubing string, and with the closure member in closed position;

FIGS. 1A—1A and 1B—1B are cross-sectional views of the valve, as seen long broken lines 1A—1A and 1B—1B, respectively, of FIG. 1;

FIG. 2 is a vertical sectional view of the valve, similar to FIG. 1, but upon the bleeding of the pressure of well fluid from above the closure member so as to cause the retainer to move to its upper position, with the toggle links held in extended positions to which they were lifted upon raising of the retainer to its upper position and the solenoid energized;

FIGS. 2A—2A and 2B—2B are cross-sectional views of the valve, as seen long broken lines 2A—2A and 2B—2B, respectively, of FIG. 2;

Figure 9A:
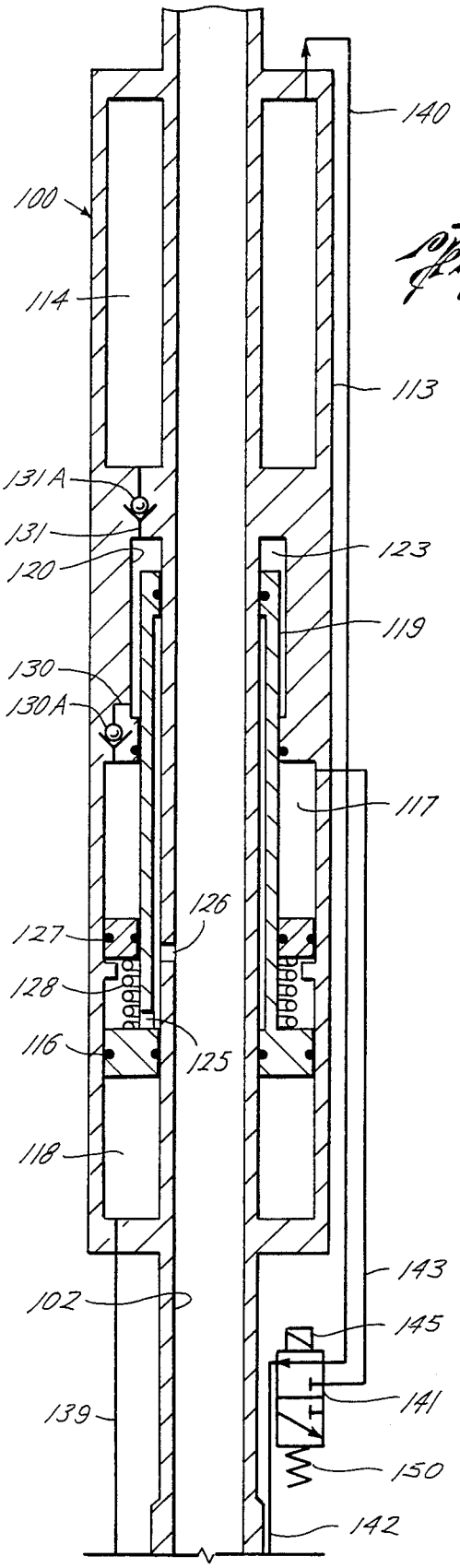
Figure 9B:
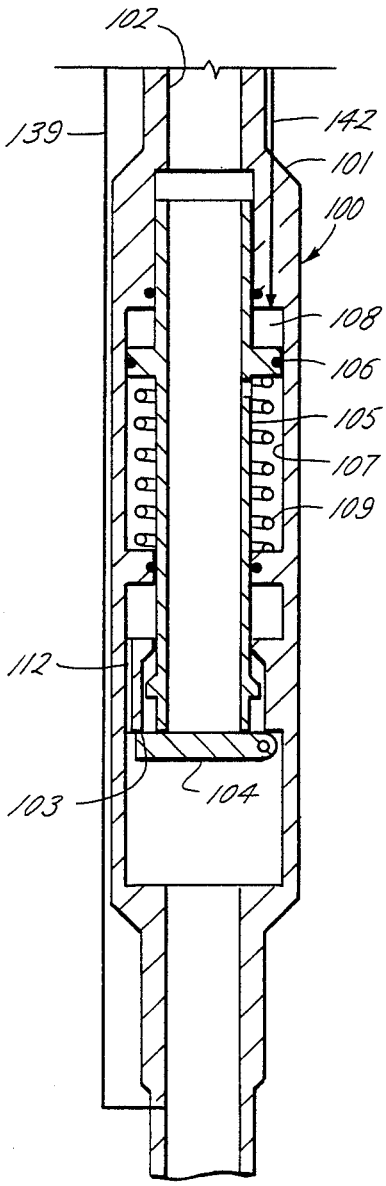

FIGS. 8A and 8B are vertical sectional views of the upper and lower ends of a valve constructed in accordance with the second described embodiment of the invention, and adapted to be connected to the lower end of a tubing string so that it may be lowered with the tubing string and packed within a well bore, pressure in the tubing string above the closure member having been bled off so as to increase the pressure differential across the closure member and thereby increase the pressure of fluid in the accumulator, and the actuator in the position it occupies upon loss of a controlled condition;

FIGS. 9A and 9B are views of the valve similar to FIGS. 8A and 8B, but upon establishment of the controlled condition so as to cause the actuator to move to a position in which it releases the accumulator fluid to urge the flow tube downwardly to permit pressure across the closure member to equalize; and FIGS. 10A and 10B are further cross-sectional views of the upper and lower ends of the valve, but upon further lowering of the flow tube to move the closure member to open position and compress the spring which normally urges the flow tube to its upper position, whereby energy generated in the spring will, upon loss of the controlled condition and return of the actuator to the position of FIGS. 8A and 8B, raise the flow tube to permit the closure to return to closed position.

With reference now to the details of the above described drawings, and particularly the embodiment of FIGS. 1 to 7, the lower end of a production tubing 10 is shown in each of FIGS. 1 to 4 to extend within a well bore 11 which may be lined with casing, and to be packed off at 12 to close the annular space between it and the well bore above a production zone from which oil or gas is to be recovered through the tubing. As also shown in each of FIGS. 1–4, the valve of the present invention, which is indicated in its entirety by reference character 13, is located in the well bore to control the flow of fluid through the tubing, and, more particularly, to fail closed upon the loss of a controlled condition, as will be described to follow. Thus, it is connected to the lower end of a tubular member 14 which is supported within the tubing string 10 by means of locking elements 15 recevied within a recess 16 in the bore of the tubing string 10, and then sealed with respect thereto by a packing 17 about the tubular member 14.

As shown, the valve 13 includes a generally cylindrical body 18 having its open upper end threadedly and sealably connected to the lower end of tubular member 14, and having ports 19 in its side connecting with the well bore beneath the lower end of the tubing string 10. A seat 21 is formed on the body within the flowway between the ports and the open upper end of the body 18, and a closure member including a sleeve 22 is vertically reciprocal within the body between an upper position in which the sleeve engages the seat to close the valve, as shown in FIGS. 1 and 2, and a lower position in which it is spaced from the seat, substantially at the level of the lower end of the ports 19, so as to open the flowway, as shown in FIGS. 3 and 4.

Figure 1:
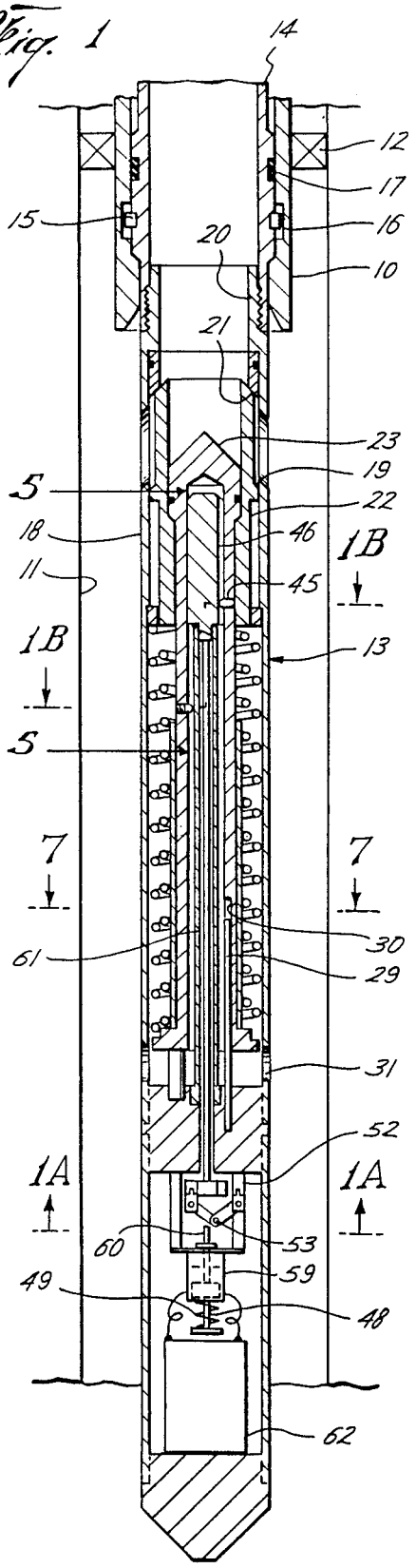
Figure 2:
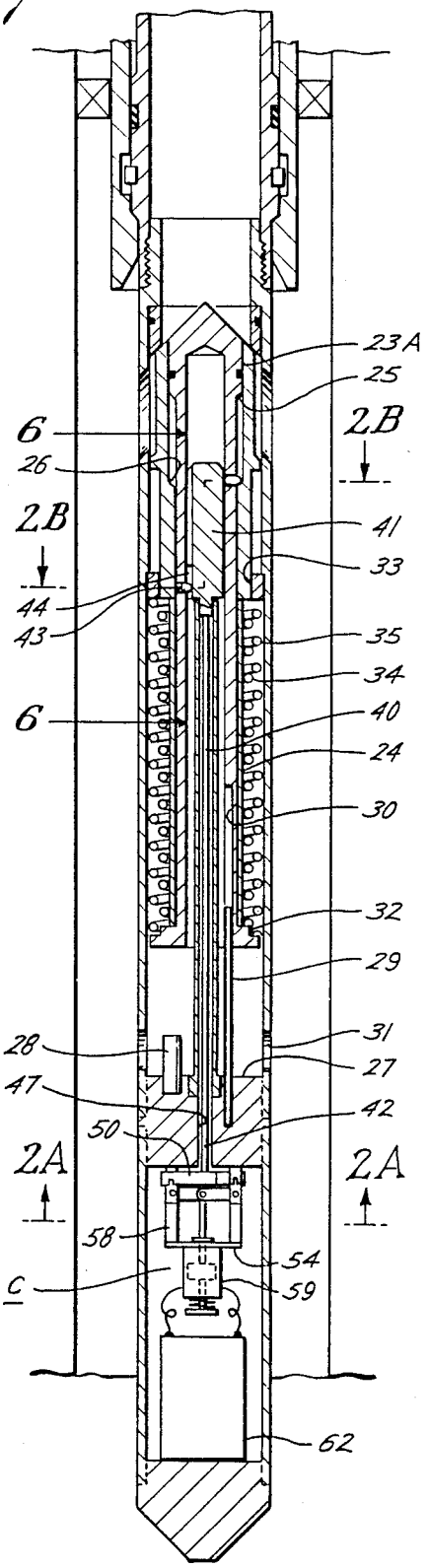
Figure 3:
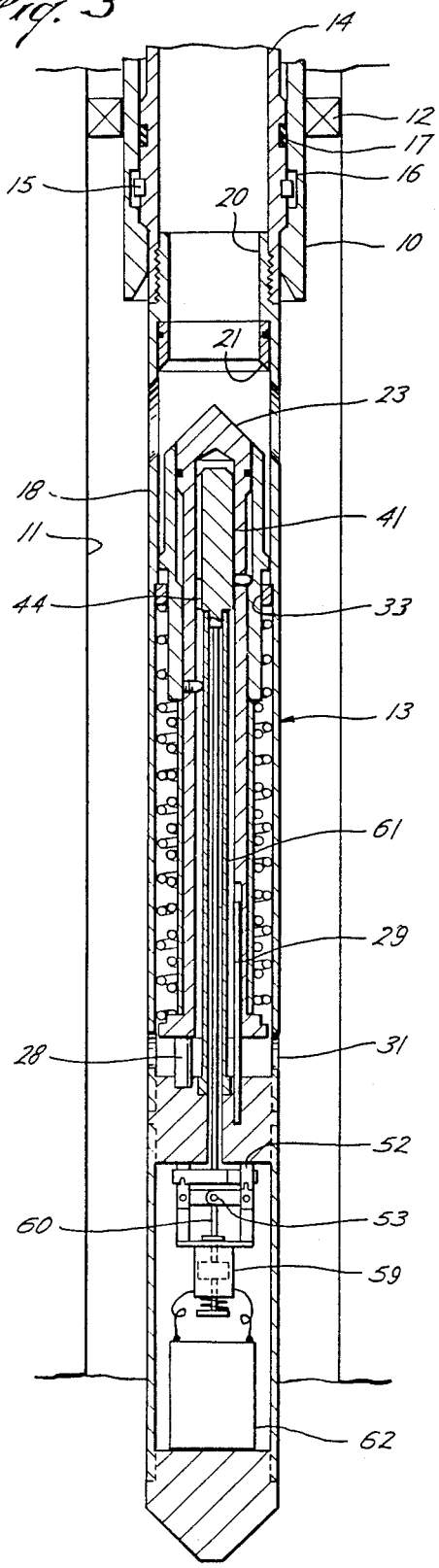
FIG. 3 is another vertical sectional view of the valve, similar to FIGS. 1 and 2, but upon lowering of the closure member to its open position in response to balancing the pressure of well fluid across the closure member.
Figure 4:
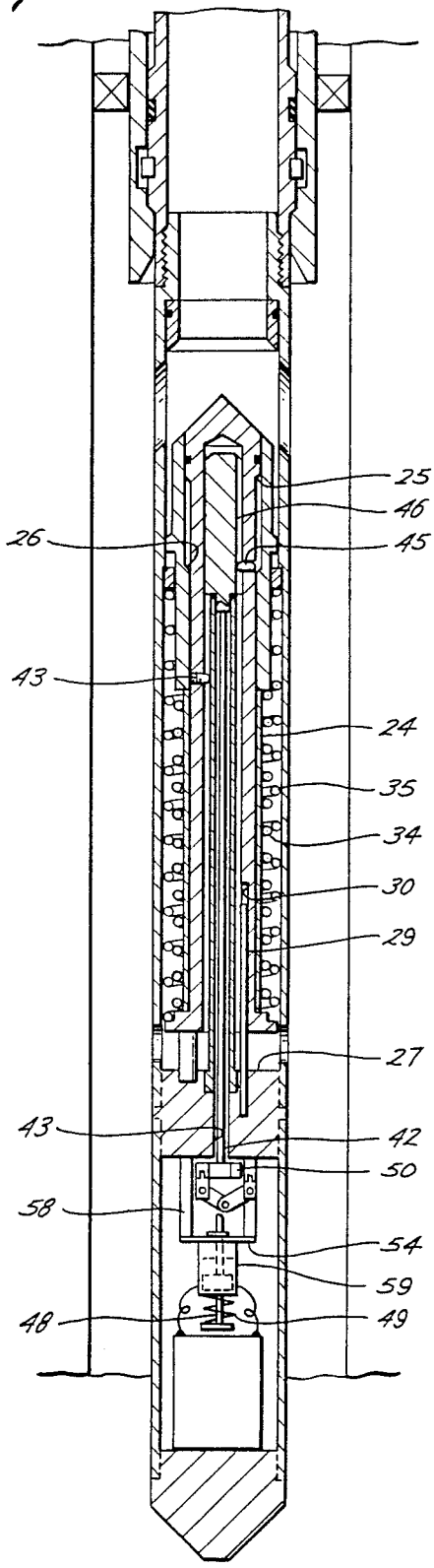
FIG. 4 is still another vertical sectional view of the valve, similar to FIGS. 1, 2 and 3, but upon retraction of the end of the solenoid, in response to the loss of power from the battery, so as to unlock the retainer and closure member and permit the closure member to be moved upwardly to the closed position of FIG. 1.

A retainer 23 is guideably reciprocal within the closure member sleeve 22 between an upper position with respect thereto, as shown in FIGS. 2, 3 and 4, wherein its upper end provides an upwardly extending conical continuation of the upper end of the sleeve, and a lower position with respect thereto, as shown in FIG. 1. The retainer is located in its upper position with respect to the closure member sleeve by the engagement of a sleeve 24 thereabout with the lower end of the closure member sleeve 22, and is located in its position with respect to the closure member sleeve by engagement of a shoulder 25 about the retainer with a seat 26 formed on the inner diameter of the sleeve 22. A piston 23A at the upper end of the retainer is sealably reciprocable within the closure member sleeve, so that, as will be described to follow, the retainer may be caused to reciprocate between its upper and lower position, in order to generate energy which is used in opening, closing and reopening the valve in response to the pressure of the well fluid above and below it when closed.

The body of the valve includes a transverse wall 27 which separates it into an upper chamber in which the valve closure member and retainer are disposed, and a lower chamber C which, as will be described, is maintained at atmospheric pressure and in which the battery solenoid and other electrical components of the communication system for the valve are contained. A pin 28 extends upwardly from the wall 27 to provide a stop for engaging the lower end of the retainer and thus limiting its downwardly movement with respect to the valve body. The retainer is held against rotation with respect to the body by means of a rod 29 extending upwardly from the wall 27 into a longitudinal slot 30 formed on the inner diameter of the retainer adjacent its lower end. The slot is of such length that the rod remains within it during reciprocation of the retainer with respect to the valve body. Since the upward movement of the retainer with respect to the closure member sleeve is limited by engagement of sleeve 24 with the lower end of the valve member sleeve 22, the upward movement of the retainer with respect to the body is limited by engagement of the upper end of the valve member sleeve with the seat 21 of the valve body.

Ports 31 are formed in the side of the valve body above the transverse wall 27 so that well pressure is balanced within and without the valve body beneath retainer piston 23A. Of course, when the valve member is in the open position of FIGS. 3 and 4, the pressure of the well fluid above and below the closure member is substantially the same. On the other hand, when the valve member has been moved to the closed position of FIGS. 1 and 2, the well fluid above the closure member may be bled off so as to create an upwardly directed pressure differential across the closed valve member, which, for purposes previously mentioned and to be described in detail to follow, causes the retainer to be raised to the position of FIG. 3 in order to set or reset the valve for movement to its open position of FIG. 3.

The retainer has a flange 32 about its lower end, and a stop 33 is mounted on the inner diameter of the body above the flange and generally intermediate the upper and lower ends of the body. A first coil spring 34 surrounds the retainer sleeve 24 and is compressed between the lower end of the valve closure member sleeve 22 and the flange 32 so as to urge the valve closure member upwardly with respect to the retainer sleeve, and a second coil spring 35 is disposed about the first coil spring and is compressed at its opposite ends between the stop 30 and the flange so that it urges the retainer downwardly with respect to the valve body, and thus, as shown in each of FIGS. 1, 3 and 4, into a lower position in which the lower end of the retainer engages stop 28.

When the valve is closed, as shown in FIG. 1, either upon installation or in repsonse to the loss of the controlled condition, both the first and second springs are fully expanded or deenergized. Well fluid pressure above the closure member may be bled off to cause the retainer member to rise to the position of FIG. 2, and thereby compress and energize the springs in order to generate energy therein. The solenoid is energized to cause it to move to a position in which the retainer is locked in its upper position with respect to the closure member, so long as the controlled condition has been established and maintained, in order to set or reset the valve.

At this time, the pressure of well fluid above the closure member may be restored to substantially balance pressure aross the valve, and thus permit the coil spring 35 to be deenergized or expanded so that the energy generated therein lowers the retainer and thus lower the closure member with retainer to open the valve, as shown in FIG. 3. As long as the controlled condition is maintained, the valve will remain open.

However, when the controlled condition is lost, the retainer and closure member are unlocked to release the energy generated in the first coil spring 34 in order to move the closure member upwardly with respect to the retainer and into engagement with the seat 21 to close the valve, as shown in FIG. 1.

Figure 5:
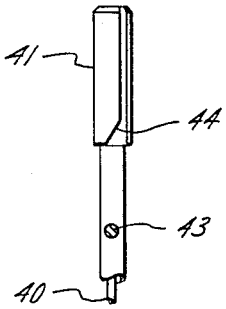
FIG. 5 is a side view of the control rod removed from the retainer, and as seen along broken lines 5—5 of FIG. 1.
Figure 6:
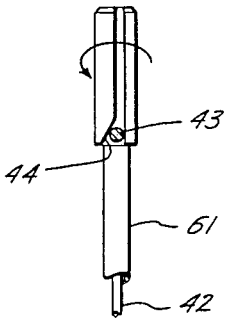
FIG. 6 is another side view of the rod, as seen along broken lines 6—6 of FIG. 2.
Figure 7:
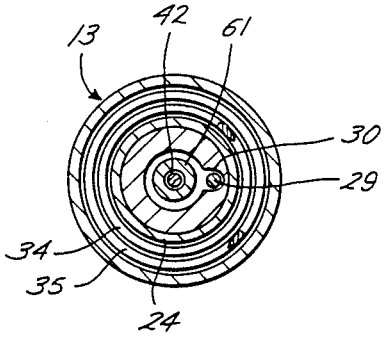
FIG. 7 is another cross sectional view of the valve, as seen along broken lines 7—7 of FIG. 1.

As also shown in each of FIGS. 1–4, a rod 40 extends longitudinally within the retainer, and has an enlarged head 41 at its upper end which fits closely within the upper hollow end of the retainer, and a lower end 42 which extends through a hole 47 in the transverse wall 27 of the body connecting the upper and lower chambers thereof. A pin 43 carried by the retainer projects into its inner diameter to a position beneath the enlarged head 41 of the rod when the retainer is in a lower position with respect to the rod, as shown in FIGS. 1 and 5. As the retainer 23 moves upwardly, the pin 43 moves into the lower end of a slot 44, in the head of the rod, as shown in FIGS. 2 and 2B, which slot, as shown in FIG. 6, extends at an angle with respect to the vertical so as to rotate the rod approximately 10° with respect to the retainer as the retainer moves to its upper position, as shown in FIGS. 2 and 6.

A pin 45 is also carried within a hole extending through the retainer at a location opposite the enlarged head 41 of the rod and thus in a position to move above shoulder 26 on the inner diameter of the sleeve, as well fluid pressure above the retainer is bled off to cause it to be moved upwardly to the position of FIG. 2, and pin 43 on the retainer to move into slot 44. As shown in FIG. 2B, the resulting rotation of the head of the rod cams the inner end of pin 45 out of a slot 46 in the right side of the head, and beyond the outer diameter of the retainer above the seat 26. At this time then, the retainer is locked against downward movement with respect to the valve member sleeve, and, conversely, the valve member sleeve is locked against upward movement with respect to the retainer. Since the sleeve 34 has engaged the lower end of the closure member sleeve, the retainer is held aginst further upward movement with respect to the closure member, which of course is seated and thus prevented from moving up.

Figure 1A:
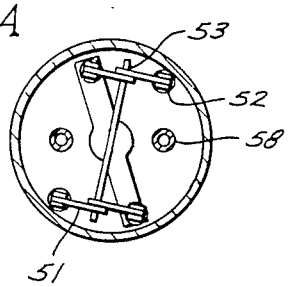
Figure 2A:
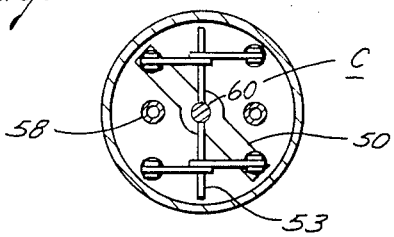
Figure 2B:
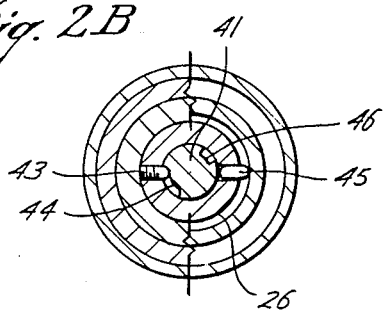

As shown in FIGS. 1A and 2A, as well as in FIGS. 1–4, the lower end 42 of the rod which extends through hole 47 in the wall 27 is connected to an arm within the atmospheric chamber C so as to rotate the arm from the position shown in FIG. 1A to the position shown in FIG. 2A as the retainer moves upwardly from the position of FIG. 1 to the position of FIG. 2, and thus as the pin 43 moves into the slot 44 in the head on the upper end of the rod so as to transmit rotation to the rod relative to the retainer. Each outer end of the arm 50 is pivotally connected to one arm of a toggle links 51 having its other arm pivotly connected to a bracket 52 extending downwardly from the transverse wall 27 within the atmospheric chamber, and the arms of the toggle links are connected to one another by means of a rod 53 extending between them. As will be understood from the drawings, rotation of the arm 50 with the control rod 40 will move the outer ends of the toggle links further apart, and thus move the toggle links from the collapsed position of FIG. 1 to the extended position of FIG. 2. Swivel pin connections are provided between the ends of the arms and the links, as well as between the brackets and the links.

A platform 54 is suspended from the lower side of the transverse wall 27 by bracket arms 58 extending downwardly from the wall to support a solenoid 59 with an extendible and retractable end 60. When the toggle links are extended, and the solenoid is energized, the end 60 of the solenoid is raised with the rod to the position shown in FIG. 2 to hold the links extended so long as the controlled condition is maintained. On the other hand, when the valve is open, as shown in FIG. 4, and the controlled condition is lost, the solenoid is inoperable to oppose the force of a small spring acting 48 between the body of the solenoid and an end of the solenoid opposite the end 60. Thus, the links are moved off dead center to permit them to be collapsed, in response to rotation of the control rod, as shown in FIG. 4, and thus release the closure member for upward movement from the position of FIG. 4 to the position of FIG. 1.

Figure 1B:
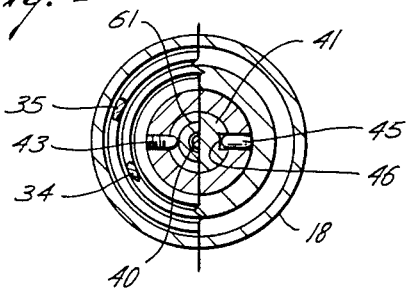

A torque tube 61 surrounds the control rod and is anchored at one end to the transverse wall 27 of the valve body and at the upper end to the head of the control rod. The torque tube thus provides a spring force for urging the control rod from the position of FIG. 3 to the position of FIG. 4, so as to rotate the enlarged upper end of the control rod to a position in which slot 46 is opposite the inner end of pin 45. Thus, as shown in FIGS. 1 and 1B, the pin may be urged inwardly from above shoulder 26 and into slot 46 to free the closure member sleeve for moving upwardly with respect to the retainer, and thus from the position of FIG. 4 into the closed position of FIG. 1 in engagement with the seat 21. Also, of course, the torque tube closes the annular space about the rod as the rod rotates between its alternate positions and thus closes the chamber C.

The solenoid 59 is electrically connected to a battery pack within a container 62 mounted within the atmospheric chamber C, as shown in broken lines in FIGS. 1 to 4. When well pressure above the closure member has been bled off and the solenoid has been energized to retain the toggle linke extended, as shown in FIG. 2, the links are held extended so long as the controlled condition is maintained to cause the battery to activate the solenoid.

To summarize operation of the valve, and assuming it to be in the reset position of FIG. 2 wherein energy is generated in both of the coil springs, and the solenoid to have been activated to engage its end 60 with the rod 53 extending between the toggle links, and thus hold the toggle links in extended position, well pressure may be equalized across the closed valve member to pemit energy generated in coil spring 35 to be released in order to move both the valve member and the retainer downwardly from the closed position of FIG. 2 to the open position of FIG. 3. Although this removes pin 43 from slot 44, the rod is not free to rotate, and the pin 45 continues to remain in a locked position to hold the retainer in its upper position with respect to the closure member, as long as the solenoid is rendered operative. However, when the solenoid is rendered inoperative, spring 48 moves the toggle links off center to permit them to be collapsed by the spring force in the torque tube. As the arm 50 is so rotated, the head at the upper end of the control rod is rotated to a position in which the slot 46 therein is opposite the pin 45 so as to receive the pin, as shown in FIG. 4, and thereby unlock the retainer and closure member sleeve to permit the sleeve be moved upwardly by the inner coil spring 34 from its lower position with respect to the retainer to its upper position with respect thereto and thus to move the upper end of the closure member into engagement with the seat 21 to close the valve, as shown in FIG. 1.

As previously described, the controlled condition in the illustrated embodiment of the invention is the maintenance of a power level in the battery pack sufficient to activate the solenoid, and thus hold the toggle links in extended positions. This invention contemplates that a signal may be transmitted from the earth's surface to a switch in a receiver in the container 62 for closing it to electrically connect the battery pack to the solenoid, and thus activate the solenoid so long as the power level of the battery pack has not been drained below the necessary level. This signal could, as previously mentioned, be electromagnetically communicated through the earth itself, and the receiver could include an antenna adapted to receive and transmit the signal to the switch. In any event, this signal may be selectively interrupted so as to deactivate the solenoid by disconnecting it from the battery pack, and thus rendering the solenoid inoperative to hold the toggle links. As also previously mentioned, however, the valve is fail-safe even if the signal continues to be transmitted, but the level of the power of the battery pack has fallen below the predetermined level whereby the solenoid is rendered inoperative to hold the energy generated in the inner coil spring.

As shown in each of the FIGS. 8A–8B, 9A–9B and 10A–10B, the valve made in accordance with the second embodiment of the invention, and indicated in its entirety by reference character 100, comprises an elongate tubular body 101 adapted to be connected to the lower end of tubing string for lowering therewith into a well bore (not shown) and having a bore 102 therethrough, which, when the body is so connected, forms a continuation of the lower end of tubing string. Thus, when the tubing string is packed off within the well bore, as previously described in connection with the first embodiment, valve 100 is adapted to control the flow of well fluid within the tubing string. Thus, a seat 103 formed about the bore in the lower end of the tubular body is adapted to be opened and closed by means of a flapper 104 pivotally mounted on the body to one side of the bore and yieldably urged to closed position by a torsion spring (not shown).

A flow tube 105 is mounted within the bore of the tubular body for reciprocation between an upper position in which its lower end is above the closed flapper 104, as shown in FIG. 8B, and a lower position in which well fluid pressure across the flapper is equalized and its lower end engages and moves the flapper to its open position, as shown in FIG. 10B. As shown in FIG. 9B, and as will be described, the flow tube is initially lowered to a position in which well fluid pressure across the flapper is equalized and its lower end engages the flapper 104 prior to further downward movement in order to swing flapper to its open position.

The flow tube carries a piston 106 thereabout for sealably sliding within an enlarged portion 107 of the bore so as to form an expandable and contractible fluid chamber 108 between its upper end and the upper end of the enlarged bore portion 107. The flow tube is urged to its upper position by means of a coil spring 109 which is compressed between the lower side of the piston and lower end of the enlarged bore portion 107. Thus, the flow tube normally occupies its upper position when the flapper is closed, but is adapted to be moved downwardly to its lower position in response to the supply of accumulator fluid to the chamber 108, as will be described to follow.

A flange 110 about the flow tube is seatable upon a downwardly facing shoulder 111 in the bore of the tubular body when the flow tube is in its upper position. Also, a port 112 is formed in the body to connect its bore above and below the shoulder 111. Thus, as the flow tube first moves downwardly from its upper position to the position shown in FIG. 8B, well fluid within the valve above the flapper flows through the port 112 to bypass the flapper 104 and thus equalizes pressure across the flapper so as to eliminate the large upwardly directed force due to well fluid holding the flapper closed.

As previously mentioned, in these respects, the valve is similar in construction to existing control fluid operated, self equalizing, fail closed tubing safety valves.

The tubular body also includes an outer wall 113 which is spaced concentrically about its inner wall in which the bore is formed to provide upper and lower annular spaces 114 and 115 which are closed at their opposite ends by end walls extending between the inner and outer walls. The upper space forms an accumulator vessel of fixed volume, and a piston 116 is vertically reciprocable in the lower space to divide it into upper and lower, expandable and contractible chambers 117 and 118, respectively. The piston 116 has an upper extension 119 which extends into an upwardly extending annular recess 120 forming an upper continuation of the upper chamber 117. The piston extension 119 carries a seal ring about its inner diameter for sealably sliding over the inner wall of the tubular body, and a seal ring is carried about the outer wall in the lower end of the recess 120 for sealably engaging about the outer diameter of the extension 119 to form an annular chamber 123 intermediate the chamber 117 and the vessel 114.

A port 125 is formed in the piston extension 119 near the piston 116, and a port 126 is formed in the inner wall of the tubular body above the lower chamber 118, thereby providing conduit means connecting the bore in the tubular body above the flapper with the lower end of the chamber 117. The upper chamber is connected with the intermediate chamber 123 by means of a conduit 130, and the intermediate chamber is connected with the vessel 114 by means of a conduit 131. More particularly, check valves 130A and 131A are disposed in the conduits 130 and 131, respectively, to permit to pass into but not out of the vessel 114 and chamber 123. A separator piston 127 is vertically reciprocable within the upper chamber 117 to divide it into upper and lower portions and thereby separate well fluid in chamber 117 beneath the piston from accumulator fluid thereabove, and a spring 128 is compressed between the piston 127 and the piston 116 in the lower portion of the chamber 117.

A conduit 139 connects the bore of the tubular body beneath the flapper 104 with the lower chamber 118, so that with the flapper closed, and the pressure within the tubing string above the flapper vented, a large force due to well fluid at high pressure urges the piston 116 upwardly. Thus, as will be described, when the controlled condition is lost, this well fluid pressure is effective to raise the piston and thus apply pressure to accumulator fluid in the chambers 117 and 123 and vessel 114 so at to generate energy therein.

A valve 141 is vertically shiftable between an upper position in which, as shown in FIG. 8A, it connects a conduit 142 leading from the chamber 108 with a conduit 143 leading to the accumulator chamber 117 while disconnecting conduit 142 from a conduit 140 leading to accumulator vessel 114, and a lower position in which, as shown in FIGS. 9A and 10A, it connects conduit 140 with conduit 142 while disconnecting conduit 142 from conduit 143. Thus, in its lower position, valve 141 releases high pressure fluid from the accumulator to the chamber 108 above the flow tube piston in order to urge the flow tube downwardly towards its lower position. However, in the upper position of the valve, as shown FIG. 8A, the valve 141 releases accumulator pressure fluid for return from the chamber 108 to the accumulator chamber 117, and thus permits the flow tube to be raised by spring 109 to permit the flapper to close.

Prior to establishment of the controlled condition, or following its loss, the flapper 104 is closed and the valve 141 is raised to its upper position by spring 150 so that, as shown in FIGS. 8A and 8B, venting of tubing pressure above the flapper creates a pressure differential thereacross and thus urges piston 116 upwardly to pressurize the accumulator fluid. A solenoid 145 which is connected to the valve and which is powered by a battery (not shown), as in the first embodiment, is actuated in response to a signal delivered to the battery from the earth's surface to shift the valve 141 to its lower position so as to release accumulator fluid for flow from the vessel 114 into the chamber 108 to cause the flow tube 105 to begin to move downwardly. As previously described, initial downward movement of the flow tube permits the well fluid pressure to equalize across the closed flapper so that, the flow tube need only overcome a relatively small force due to the torsion spring urging the flapper closed in order to continue to move downwardly and thereby open the flapper. Thus, as long as the controlled condition is maintained following equalization, accumulator fluid will continue to flow into the chamber 108 to continue to move the tube downwardly to move the flapper to its open position, as shown in FIG. 10B.

At the same time, the downward movement of the flow tube has compresed the spring 107 so as to generate energy therein, and pressure equalization across the closure member permits spring 128 to lower piston 116 and accumulator fluid to pass through valve 130A into chamber 123. Consequently, when the condition is no longer maintained, the solenoid is deactivated to permit spring 150 beneath the valve 141 to raise the valve to its upper position, at which time pressure fluid in the chamber 108 is released for return through the conduit 143 to the upper chamber 117 of the accumulator, and thus move separator piston 127 down as spring 109 raises the flow tube to permit flapper 104 to close. At this time, return of the pressure differential across the closure member will pressurize accumulator fluid.

From the foregoing, it will be seen that this invention is one well adapted to attain all of the ends and objects hereinabove set forth, together with other advantages which are obvious and which will are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claims is:

1. A valve, comprising a body having a flowway therethrough, a closure member moveable between positions opening and closing the flowway, means in which energy is generated in response to a pressure differential across the closure member while the closure member is in closed position, means operable, upon a reduction in the pressure differential, for releasing generated energy in order to move the closure member from closed to open position and hold it in open position so long as a controlled condition is maintained, and means operable, upon the loss of said controlled condition, for releasing further generated energy in order to move the closure member from open to closed position.

2. As in claim 1, including a power source, and means including an actuator adapted to be activated by the power source, in response to a signal transmitted from a location remote from the valve, for preventing release of the further generated energy so long as the power level of the power source is adequate to activate the actuator, said actuator being inoperable to prevent release of the further generated energy when said power level is lost as a result of the interruption of said signal and/or power drain from the power source.

3. As in claim 2, wherein the power source is a battery and the actuator comprises a solenoid.

4. As in claim 1, wherein the means in which energy is generated includes spring means.

5. As in claim 4, wherein energy generated in said spring means is effective to move the closure member from closed to open position in response to the reduction of pressure differential thereacross, and, further energy generated therein is effective to move the closure member from open to closed position, upon the loss of said controlled condition.

6. As in claim 1, wherein the means in which energy is generated includes an accumulator.

7. As in claim 6, wherein the means in which energy is generated also includes spring means, and energy generated in the accumulator is effective to reduce the pressure differential across the closure member and then move the closure member from closed to open position, the movement of the closure member from closed to open position generating energy in said spring means which is effective to move the closure member from open to closed position.

8. As in claim 2, including means for activating the actuator following establishment of the reduction of pressure differential across the closure member.

9. As in claim 2, including means for activating the actuator prior to establishment of a pressure differential across the the closure member.

10. As in claim 9, wherein the pressure differential is established automatically in response to movement of the closure member from closed to open position.

11. As in claim 1, including means including a solenoid which is responsive to the supply thereto of electrical power for preventing release of the further generated energy so long as the power is maintained at a predetermined level, and which is inoperable to prevent release of the further generated energy when said power drops below said predetermined level.

12. As in claim 10, including means including a solenoid which is responsive to the supply thereto of electrical power for preventing release of the further generated energy so long as the power is maintained at a predetermined level, and which is inoperable to prevent release of the further generated energy when said power drops below said predetermined level.

13. As valve, comprising a body having a flowway therethrough, a closure member moveable between positions opening and closing the flowway, spring means in which energy is generated, in response to a pressure differential across the closure member, while the closure member is in closed position, means operable, upon a reduction in the pressure differential, for releasing energy generated in the spring means in order to move the closure member from closed to open position and hold it in open position so long as a controlled condition is maintained, and means operable, upon the loss of said controlled condition, for releasing further energy generated in the spring means in order to move the closure member from open to closed position.

14. As in claim 13, including a power source, and means including an actuator adapted to be activated by the power source, in response to a signal transmitted from a location remote from the valve, for preventing release of the further generated energy so long as the power level of the power source is adequate to activate the actuator, said actuator being inoperable to prevent release of the further generated energy when said power level is lost as a result of the interruption of said signal and/or power drain from the power source.

15. As in claim 12, the power source is a battery and wherein the actuator comprises a solenoid.

16. A valve, comprising a body having a flowway therethrough, a closure member moveable between positions opening and closing the flowway, an accumulator containing fluid whose pressure is increased in order to generate energy therein in response to a pressure differential across the closure member while the closure member is in its closed position, means operable, upon a reduction in the pressure differential, for releasing pressurized fluid from the accumulator in order to move the closure member to open position and hold it in open position so long as a controlled condition is maintained, spring means in which further energy is generated in response to movement of the closure member from closed to open position, and means operable, upon the loss of said controlled condition, for releasing the energy generated in the spring means in order to move the closure member from open to closed position.

17. As in claim 16, including a power source, and means includng an actuator adapted to be activated by wherein the power source, in response to a signal transmitted from a location remote from the valve, for preventing release of the further generated energy so long as the power level of the power source is adequate to activate the actuator, said actuator being inoperable to prevent release of the further generated energy when said power level is lost as a result of the interruption of said signal and/or power drain from the power source.

18. As in claim 17, the power source is a battery and the actuator comprises a solenoid.

19. As in claim 16, including means including a solenoid which is responsive to the supply thereto of electrical power for preventing release of the further generated energy so long as the power is maintained at a predetermined level, and which is inoperable to prevent release of the further generated energy when said power drops below said predetermined level.

20. A valve, comprising a body having a flowway therethrough, a closure member moveable between positions opening and closing the flowway, a spring retainer moveable with respect to the closure member, first spring means acting between the retainer and body, second spring means acting between the retainer and closure member, means operable, in response to a pressure differential across the closure member, while the closure member is in its closed position, for shifting said retainer and closure member from a first to a second position with respect to one another, in order to generate energy in said first and second spring means, and to lock said retainer and closure member in said second position, means operable, upon a reduction in the pressure differential, for permitting energy generated in said first spring means to move the closure member with the retainer from its closed to its open position and hold it in open position so long as a controlled condition is maintained, and means operable, upon the loss of said controlled condition, for releasing said retainer and closure member for movement from their second to their first position, whereby the closure member may be moved to closed position by energy generated in the second spring means.

21. As in claim 20, including a power source, and means including an actuator adapted to be activated by the power source, in response to a signal transmitted from a location remote from the valve, for preventing movement of the retainer and closure member from their first to their second position so long as the power level of the power source is adequate to activate the actuator, said actuator being inoperable to prevent movement of the retainer and closure member to their second position when said power level is lost as a result of the interruption of said signal and/or power drain from the power source.

22. As in claim 21, the power source is a battery and wherein the actuator comprises a solenoid.

23. As in claim 20, including means including a solenoid which is responsive to the supply thereto of electrical power for preventing release of the further generated energy so long as the power is maintained at a predetermined level, and which is inoperable to prevent release of the further generated energy when said power drops below said predetermined level.

24. A valve, comprising a body having a flowway therethrough, a closure member moveable between positions opening and closing the flowway, a flow tube reciprocable in the body between a first position permitting the closure member to closed position and a second position moving the closure member to open position, spring means acting between the flow tube and body to urge the flow tube to its first position, and accumulator, means responsive to a pressure differential across the closure member, when the closure member is in closed position, for increasing the pressure of fluid contained in the accumulator, means on the flow tube forming an expandable and contractible flow chamber, means operable upon maintenance of the controlled condition to release pressurized fluid from the accumulator into the chamber for moving the flow tube toward its second position, means responsive to movement of the flow tube toward its second position for equalizing pressure across the closure member so that the flow tube continues to move to its second position in order to move the closure member to open position and hold the closure member in its open position as long as the controlled condition is maintained, means operable, upon the loss of said controlled condition, to permit the pressurized fluid to return from the chamber back to the accumulator, whereby energy generated in the spring means as the flow tube moves to its second position is released in order to return the flow tube to its first position and thereby permit the closure member to close.

25. As in claim 24, including a power source, and means including an actuator adapted to be activated by the power source, in response to a signal transmitted from a location remote from the valve, for preventing release of the pressurized fluid for return to the accumulator so long as the power level of the power source is adequate to activate the actuator, said actuator being inoperable to prevent release and return of the pressurized fluid when said power level is lost as a result of the interruption of said signal and/or power drain from the power source.

26. As in claim 25, wherein the power source is a battery and the actuator comprises a solenoid.

27. As in claim 24, wherein the accumulator includes a vessel and means having first and second oppositely facing pressure responsive surfaces connecting with the flowway on opposite sides of the closure member in order to increase the pressure of the fluid contained in the accumulator, when there is a pressure differential across the closure member, and to permit such pressure to decrease when the closure member is open, and the means operable to release and permit the return of pressurized fluid to and form the accumulator includes valve means moveable between a first position connecting the vessel and chamber as long as the controlled condition is maintained, and a second position connecting the chamber, with said fluid responsive surface.

28. As in claim 24, including means including a solenoid which is responsive to the supply thereto of electrical power for preventing release of the further generated energy so long as the power is maintained at a predetermined level, and which is inoperable to prevent release of the further generated energy when said power drops below said predetermined level.

29. A valve for controlling flow through a well bore, comprising a body having a flowway therethrough to form a continuation of the well bore, a closure member moveable between positions opening and closing the flowway, means in which energy is generated, in response to a pressure differential across the closure member, while the closure member is in closed position, means operable, upon a reduction in the pressure differential, for releasing generated energy in order to move the closure member from closed to open position and hold it in said open position so long as a controlled condition is maintained, and means operable, upon the loss of said controlled condition, for releasing further generated energy in order to move the closure member from open to closed position.

30. As in claim 29, including a power source, and means including an actuator adapted to be activated by the power source, in response to a signal transmitted from the earth's surface, for preventing release of the further energy generated so long as the power level of the power source is adequate to activate the actuator, said actuator being inoperable to prevent release of the further generated energy, when said power level is lost as a result of the interruption of said signal and/or power drain from the power source.

31. As in claim 30, wherein the power source is a battery and the actuator comprises a solenoid.

32. As in claim 29, wherein the means in which energy is generated includes spring means.

33. As in claim 32, wherein the spring means acts between the closure member and body, and further energy generated in the spring means moves the closure member from open to closed position.

34. As in claim 29, wherein the means in which energy is generated includes an accumulator.

35. As in claim 34, wherein the means in which energy is generated also includes spring means, and energy generated in the accumulator is effective to reduce pressure differential across the closure member and then move the closure member from closed to open position, the movement of the closure member from closed to open position generating energy in spring means which is effective to move the closure member from open to closed position.

36. As in claim 31, including means for activating the actuator following establishment of the reduction of pressure differential across the closure member.

37. As in claim 30, including means for activating the actuator prior to establishment of pressure differential across the the closure member.

38. As in claim 37, wherein the pressure differential is established automatically in response to movement of the closure member from closed to open position.

39. As in claim 29, including means including a solenoid which is responsive to the supply thereto of electrical power for preventing release of the further generated energy so long as the power is maintained at a predetermined level, and which is inoperable to prevent release of the further generated energy when said power drops below said predetermined level.

40. A valve for controlling flow within a well bore, comprising a body having a flowway therethrough adapted to form a continuation of a well conduit within the well bore, a closure member moveable between positions opening and closing the flowway, spring means in which energy is generated, in response to a differential in the pressure of well fluid across the closure member, while the closure member is in closed position, means operable, upon a reduction in the pressure differential, for releasing energy generated in the spring means in order to move the closure member from closed to open position, and hold it in open position so long as a controlled condition is maintained, and means operable, upon loss of said controlled condition, for releasing further energy which has been generated in the spring means in order to move the closure member from open to closed position.

41. As in claim 40, including a power source and means including an actuator adapted to be activated by the power source, in response to a signal transmitted from the earth's surface, for preventing release of the further energy generated in the spring means, so long as the power level of the power source is adequate to activate the actuator, said actuator being inoperable to prevent release of the further energy generated when said power level is lost as a result of the interruption of said signal and/or power drain from the power source.

42. As in claim 41, wherein the power source is a battery and the actuator comprises a solenoid.

43. As in claim 40, including means including a solenoid which is responsive to the supply thereto of electrical power for preventing release of the further generated energy so long a the power is maintained at a predetermined level, and which is inoperable to prevent release of the further generated energy when said power drops below said predetermined level.

44. A valve for controlling flow within a well bore, comprising a body having a flowway therethrough adapted to form a continuation of a well conduit within the well bore, a closure member moveable between positions opening and closing the flowway, an accumulator containing fluid whose pressure is increased in order to generate energy therein in response to a differential across in the pressure of well fluid the closure member while the closure member is in its closed position, means operable, upon a reduction in the pressure differential, for releasing pressurized fluid from the accumulator in order to move the closure member to open position and hold it in open position so long as a controlled condition is maintained, spring means in which further energy is generated in response to movement of the closure member from closed to open position, and means operable, upon the loss of said controlled condition, for releasing the energy generated in the spring means in order to move the closure member from open to closed position.

45. As in claim 44, including a power source, and means including an actuator adapted to be activated by the power source, in response to a signal transmitted from a location remote from the valve, for preventing release of the further generated energy so long as the power level of the power source is adequate to activate the actuator, said actuator being inoperable to prevent release of the further generated energy when said power level is lost as a result of the interruption of said signal and/or power drain from the power source.

46. As in claim 45, the power source is a battery and wherein the actuator comprises a solenoid.

47. As in claim 44, including means including a solenoid which is responsive to the supply thereto of electrical power for preventing release of the further generated energy so long as the power is maintained at a predetermined level, and which is inoperable to prevent release of the further generated energy when said power drops below said predetermined level.

48. A valve for controlling flow within a well bore, comprising a body having a flowway therethrough adapted to form a continuation of a well bore tubing in the well bore, a closure member moveable between positions opening and closing the flowway, a spring retainer moveable with respect to the closure member, first spring means acting between the retainer and body, second spring means acting between the retainer and closure member, means operable, in response to a differential in pressure of the well fluid aross the closure member, while the closure member is in its closed position, for shifting said retainer and closure member from a first to a second position with respect to one another, in order to generate energy in said first and second spring means, and to lock said retainer and closure member in said second position, means operable, upon a reduction in the pressure differential, for permitting energy generated in said first spring means to move the closure member with the retainer from its closed to its open position, and hold it in said open position so long as a controlled condition is maintained, and means operable, upon the loss of said controlled condition, for releasing said retainer and closure member for movement from their second to their first position, whereby the closure member may be moved to closed position by energy generated in the second spring means.

49. As in claim 48, including a power source and means including an actuator adapted to be activated by the power source, in response to a signal transmitted from the earth's surface, for preventing movement the retainer and closure member from their first to said second position so long as the power level of the power source is adequate to activate the actuator, said actuator being inoperable to prevent such movement when said power level is lost as a result of the interruption of said signal and/or drain from the battery.

50. As in claim 49, wherein the power source is a battery and the actuator comprises a solenoid.

51. As in claim 48, including means including a solenoid which is responsive to the supply thereto of electrical power for preventing release of the further generated energy so long as the power is maintained at a predetermined level, and which is inoperable to prevent release of the further generated energy when said power drops below said predetermined level.

52. A valve for controlling flow within a well bore, comprising a body having a flowway therethrough adapted to form a continuation of a well conduit in the well bore, a closure member moveable between positions opening and closing the flowway, a flow tube reciprocable in the body between a first position permitting the closure member to close and a second position moving the closure member to open position, spring means acting between the flow tube and body to urge the flow tube to its first position, an accumulator, means responsive to a differential in the pressure well fluid across the closure member, when the closure member is in closed position, for increasing the pressure of fluid contained in the accumulator, means on the flow tube forming an expandable and contractible fluid chamber, means operable upon maintenance of a controlled condition to release pressurized fluid from the accumulator into the chamber for moving the flow tube toward its second position, means responsive to movement of the flow tube toward its second position for equalizing the pressure of well fluid across the closure member so that the flow tube continues to move to its second position in order to move the closure member to open position and hold the closure member in its open position as long as the controlled condition is maintained, and means operable, upon the loss of said controlled condition, to permit the pressurized fluid to return from the chamber back to the accumulator, whereby energy generated in the spring means is released in order to return the flow tube to its first position and thereby permit the closure member to close.

53. As in claim 52, including a power source, and means including an actuator adapted to be activated by the power source, in response to a signal transmitted from a location remote from the valve, for preventing release of the pressurized fluid for return to the accumulator so long as the power level of the power source is adequate to activate the actuator, said actuator being inoperable to prevent release and return of the pressurized fluid when said power level is lost as a result of the interruption of said signal and/or power drain from the power source.

54. As in claim 53, the power source is a battery and wherein the actuator comprises a solenoid.

55. As in claim 53, wherein the accumulator includes a vessel and means having first and second oppositely facing pressure responsive surfaces connecting with the flowway on opposite sides of the closure member in order to increase the pressure of the fluid contained in the accumulator, when there is a pressure differential across the closure member, and to permit such pressure to decrease when the closure member is open, and the means operable to release and permit the return of pressurized fluid to and form the accumulator includes valve means moveable between a first position connecting the vessel and chamber as long as the controlled condition is maintained, and a second position connecting the chamber, with said fluid responsive surface.

56. As in claim 57, including means including a solenoid which is responsive to the supply thereto of electrical power for preventing release of the further generated energy so long as the power is maintained at a predetermined level, and which is inoperable to prevent release of the further generated energy when said power drops below said predetermined level.

57. A valve for controlling flow through a well bore, comprising a body having a flowway therethrough which forms a continuation of a conduit within the well bore, a closure member including a sleeve reciprocable within the body between an upper position closing the flowway and a lower position opening the flowway, a spring retainer reciprocable between upper and lower positions with respect to the closure member, first spring means compressed between the body and retainer to urge the retainer downwardly with respect to the body, second spring means compressed between the closure member and retainer to urge the retainer upwardly with respect to the closure member, said retainer including piston means sealably slidable within the closure member sleeve to urge the retainer to its upper position, in response to a reduction in the pressure of well fluid above the closure member, while the closure member is in its closed position, in order to generate energy in said first and second spring means, a rod mounted on the retainer for movement between first and second positions with respect thereto, means responsive to movement of the rod into its second position for locking the retainer in its upper position with respect to the closure member, and to movement of the rod into its first position for releasing said retainer for movement to its lower position with respect to the closure member, means for moving the rod to its second position when the retainer is moved to its upper position to generate energy in the first and second spring means and the closure member is in its closed position, whereby said retainer is urged by well fluid to its lower position, when the pressure differential across the piston means is reduced, so that energy generated in the first spring means is effective to move the closure member with the retainer to open position, means including an actuator on the body moveable into a position for holding the rod in its second position, and thus holding the closure member in its open position, so long as a controlled condition is maintained, said actuator being inoperable to hold the rod upon the loss of said controlled condition, and means urging the rod from its second to its first position so as to release the retainer from its upper position with respect to the closure member and permit energy generated in the second spring means to move the closure member to closed position.

58. As in claim 57, including a power source to activate the actuator, in response to a signal transmitted from the earth's surface, and so long as the power level of the power source is adequate to activate the actuator, but permit the actuator to release the rod from its second position and thereby release energy generated in the second spring means when said power level is lost as a result of the interruption of said signal and/or drain from the power source.

59. As in claim 58, wherein the power source is a battery and the actuator comprises a solenoid.

60. As in claim 51, wherein the body is adapted to be located within the well bore and has ports in the side thereof connecting with an open upper end of the body to form the flowway.

61. As in claim 57, wherein there is a seat in the flowway and the closure member sleeve is adapted to engage the seat.

62. As in claim 57, including means including a solenoid which is responsive to the supply thereto of electrical power for preventing release of the further generated energy so long as the power is maintained at a predetermined level, and which is inoperable to prevent release of the further generated energy when said power drops below said predetermined level.

63. A valve for controlling flow within a well bore, comprising, a body having a flowway therethrough and adapted to form a continuation of a well conduit in the well bore, a closure member pivotally mounted on the body for opening and closing the flowway, a flow tube reciprocable within the flowway above the closure member between an upper position in which it permits the closure member to close and a lower position in which it moves the closure member to open position, spring means acting between the body and flow tube to yieldably urge the tube to its upper position, said body having an accumulator vessel in which pressurized fluid is contained and a cylinder means in which piston means is reciprocable to form first and second expandable and contractible chambers, said flow tube having piston means thereon forming a third expandable and contractible chamber to which accumulator fluid may be supplied in order to urge the tube to its lower position, means including one way valve means connecting the first chamber with the vessel to permit pressurized fluid to flow from the first chamber into the vessel, first conduit means connecting the second chamber with the flowway beneath the closure member, the pressure of accumulator fluid is increased, when the closure member is in closed position and the pressure of well fluid thereabove is vented and permitted to decrease when the closure member is open, second conduit means connecting the first chamber with the flowway above the closure member, whereby the pressure of accumulator fluid is increased, when the closure member is in said closed position and the pressure of well fluid thereabove is vented and permitted to decrease when the closure member is open third conduit means connecting with the accumulator vessel, fourth conduit means connecting with the third chamber, fifth conduit means connecting with the first chamber, valve means moveable between a first position connecting the third and fourth conduit means so that, when the closure member is in said closed position, pressurized fluid in the accumulator vessel is released to flow into the third chamber, whereby the flow tube is urged from its upper to its lower position, and a second position in which it connects the fourth and fifth conduit means to permit pressurized fluid to return from the third chamber to the vesesl, means for equalizing the pressure of well fluid across the closure member as the flow tube moves downwardly, whereby energy generated in the accumulator fluid continues to move the flow tube downwardly to the closure member, means including an actuator for holding the valve means in its first position, and thus holding the closure member in its open position, so long as a controlled condition is maintained, said actuator being inoperable to hold the valve means in its first position upon the loss of said controlled condition, and means yieldably urging the valve means to its second position, whereby, upon return of pressurized fluid to the accumulator vessel, the energy generated in the spring means is effective to move the closure member to closed position.

64. As in claim 63, including a power source to activate the actuator in response to a signal transmitted from the earth's surface and thus hold the valve means in its first position so long as the power level of the power source is adequate to activate the actuator, but permit the actuator to release the valve means so that it may be moved to its second position when that power level is lost as result of the interruption of said signal and/or drained from the power source.

65. As in claim 64, wherein the power source is a battery and the actuator is solenoid.

66. As in claim 63, including means including a solenoid which is responsive to the supply thereto of electrical power for preventing release of the further generated energy so long as the power is maintained at a predetermined level, and which is inoperable to prevent release of the further generated energy when said power drops below said predetermined level.

* * * * *